United States Patent [19]

Taggart

[11] 4,035,903

[45] July 19, 1977

[54] METHOD OF MANUFACTURING A SACRIFICIAL ANODE ROD ASSEMBLY

[75] Inventor: Lewis W. Taggart, Tulsa, Okla.

[73] Assignee: Kaiser Aluminum & Chemical Corporation, Oakland, Calif.

[21] Appl. No.: 681,094

[22] Filed: Apr. 28, 1976

Related U.S. Application Data

[63] Continuation-in-part of Ser. No. 543,615, Jan. 23, 1975, abandoned.

[51] Int. Cl.[2] ..... B23P 3/00; B23P 25/00

[52] U.S. Cl. ..... 29/458; 29/509; 29/522; 204/197

[58] Field of Search ..... 29/458, 459, 509, 522; 204/197

[56] References Cited

U.S. PATENT DOCUMENTS

| | | | |
|---|---|---|---|
| 1,794,942 | 3/1931 | Boyle | 29/509 UX |
| 1,826,543 | 10/1931 | Hervig et al. | 29/509 UX |
| 2,313,312 | 3/1943 | Bakewell | 29/522 UX |
| 2,486,936 | 11/1949 | Fergus | 204/197 |
| 2,683,095 | 7/1954 | Paucek | 29/459 UX |
| 3,209,437 | 10/1965 | Voorhies | 29/509 X |
| 3,332,867 | 7/1967 | Miller et al. | 204/197 |
| 3,558,463 | 1/1971 | Strobach et al. | 204/197 |

*Primary Examiner*—Charlie T. Moon
*Attorney, Agent, or Firm*—Paul E. Calrow; Frank M. Hansen

[57] ABSTRACT

The invention provides a novel method of manufacturing a sacrificial anode rod assembly for cathodically protecting the internal surfaces of ferrous metal water-containing vessels, such as water heater tanks, which method provides an elongated anode rod member of a galvanically active metal and an externally threaded cap member wherein the anode rod member and cap member are connected in a tightly locked, leakproof engagement which not only results in superior mechanical and electrical properties of the anode assembly but also aids substantially in prolonging the effective life of the anode rod assembly. In the method of forming the assembly, the cap member which has an internal recess is positioned onto the extremity of the anode rod and axially aligned therewith. Through the application of a force applied to the cap member, the metal in the extremity of the anode rod is subjected to a metallurgical upsetting operation while not affecting or damaging the integrity of the external surfaces of the cap member or its external threads. The instant method causes the metal of the extremity of the anode rod member to conform to the shape of the internal recess or bore of the cap member (which recess has at least one enlarged portion remote from its opening). For further increasing the effective life of the anode rod assembly, the method also advantageously provides for forming a bulged or enlarged portion of anode metal at the base of the cap member.

6 Claims, 10 Drawing Figures

*Figs.3A,3B and 3C represent typical Prior Art Anode Rod Assemblies.*

METHOD OF MANUFACTURING A SACRIFICIAL ANODE ROD ASSEMBLY

CROSS REFERENCE TO RELATED APPLICATION

This application is a continuation-in-part application of co-pending United States application Ser. No. 543,615 filed Jan. 23, 1975, now abandoned and entitled "Sacrificial Anode Assembly".

BACKGROUND OF THE INVENTION

1. Field of Invention

This invention relates to a novel and improved method of making an anode rod assembly for the cathodic protection of metal surfaces, such as the internal ferrous metal wall surfaces of water heaters.

Metal surfaces, particularly those of ferrous material, when exposed to air and water, undergo oxidation or corrosion. Ferrous metal surfaces, such as the internal surfaces of water heater tanks, have been coated with other metals, such as zinc (galvanized), to protect the surfaces against corrosion and thereby prolonging the life of the tank. Glass lining has been used for this purpose, and, at present, almost all water heater tanks are glass lined. However, even the glass lining per se is not sufficient to afford a satisfactory long life to water heater tanks. No lining is perfect, and any defect or imperfection is a site for corrosion. Consequently, manufacturers rely upon anodes of a galvanically active metal, i.e., sacrificial anodes, to afford additional corrosion protection to the tank.

The conventional method of making an anode rod of a galvanically active metal, e.g., magnesium, aluminum, zinc and their respective alloys, is to extrude or cast the metal around a core wire or rod of another metal, generally a ferrous metal. The anode rod is disposed in a tank and fastened by a suitable means to the tank to provide a mechanical and electrical contact between the anode and the tank. In the generally used technique, the anode rod is threaded at one extremity and fitted into an internally threaded cap member, which is generally a ferrous material; however, other metals, such as brass, could be used. The cap member, in turn, is threaded by means of external threads into a suitable threaded coupling or spud located in a wall of the tank.

2. Description of Prior Art

It has been standard prior art practice to position anode rod assemblies in tanks, such as water heaters, usually by means of a mated threaded joint between an anode rod cap member and a suitable threaded member integral with or fixedly attached to a tank well. Examples of these are shown in U.S. Pat. Nos. 3,558,463; 2,568,594; 3,037,920; 3,542,663 and 2,459,123. These references further show typical means for joining the anode rod to the cap member, e.g., by a threaded joint, by adhesively bonding, by a crimping operation, or by riveting or welding.

Additionally, there are references in the general metal-working field which show the fastening of metal elements wherein one member is in the shape of a rod by means of crimping, bulging or deformation. Exemplary of these are U.S. Pat. Nos. 1,776,615; 2,434,080; 2,896,981; 3,209,437 and 3,638,505. These references, although useful as general background information in metal working or forming, neither disclose nor suggest the novel method of manufacturing the sacrificial anode assembly by the instant invention whereby there is produced a joint between an anode rod and a cap member which not only has superior mechanical and electrical characteristics but also exhibits superior corrosion resistance in the zone of the joint, a property which ensures a long effective life to a sacrificial anode rod assembly when exposed to a corrosive environment, such as that experienced in a water heater tank.

In the joining of anode rods to cap members as disclosed in the prior art, there have been certain deficiencies which have detracted from their rendering a long service life. For example, in the methods of the prior art, machining and/or threading of an anode rod extremity is done and this removes a significant amount of anode rod metal.

Further, this removal of the anode metal is at a position on the anode rod where, upon installation in a water heater, the anode rod would be subjected to excessive attack. Adhesive joining of the anode rod to the cap member has deficiencies as a joining method because if the adhesive fails, the connection between the anode rod and the cap member fails. Riveting and welding of anode rods to cap members, which are of dissimilar metals, such as is shown in U.S. Pat. No. 2,459,123, have inherent drawbacks in obtaining sound mechanical and electrical joints that will withstand the corrosive attack to which they will be exposed.

BRIEF SUMMARY OF THE INVENTION

Accordingly, it is a primary purpose of the instant invention to provide an improved method for manufacturing anode rod assemblies for the cathodic protection of the internal surfaces of ferrous metal water-containing vessels, for example, water heater tanks, wherein an extremity of an anode rod member is connected to an elongated hollow cap member having external threads and a selected wall thickness in an improved mechanical and electrical joint wherein the surfaces of the anode rod member and the internal recess of the cap member are securely and tightly locked without requiring machining and threading or otherwise removing of metal from the extremity of the anode. The anode rod assembly is comprised of an anode rod member of a galvanically active metal, such as aluminum, magnesium, zinc and their respective alloys, and a cap member of a dissimilar metal wherein the anode rod and the cap member are in a tightly locked, leakproof engagement, said engagement having a profusion or multitude of electrical or current-carrying bridges of metal particles between the engaging surfaces of said anode rod and said recess, to ensure a superior mechanical and electrical joint of an effective long life. The cap member is provided with an internal recess or bore which extends axially of the cap member and is provided with an opening at one end of the cap member. The recess has at least one portion removed from said opening which has a relatively greater diameter than that of said opening and the diameter of the recess adjacent said opening. In forming of the anode rod assembly, the anode rod member which is of a selected length, which may vary widely, for instance, from about 12 inches to 53 inches or more depending upon the length desired to be disposed in the water heater tank, is clamped and tightly held in a fixed position for a major portion of the length of the anode rod by a suitable clamping mechanism which has a plurality of force-applying surfaces which conform in configuration or shape to the external configuration of the anode rod member while allowing a minor portion of one extremity of said anode rod member to protrude a small selected amount from said force-applying surfaces. Either the extremity of the anode rod member which protrudes from the clamping surfaces or the internal recess of the elongated cap member is coated with a suitable contact lubricant, hereinafter discussed, and the cap member is then positioned onto the said extremity of the anode rod member. A force is applied to the elongated cap member by a suitable force-applying mechanism in sufficient amount to metallurgically upset the metal of the extremity of the anode rod which is positioned in the internal recess of the elongated cap member to thereby ensure that the metal of the extremity of the anode rod conforms to the shape or configuration of the internal recess of the cap member. This results in a connection wherein there is greater surface area engaging or mating between the extremity of the anode rod member and the inernal recess of the cap member, thereby creating a joint mechanically and electrically superior to prior art joints. The selected wall thickness of the elongated cap member is such that it is either sufficient to withstand the force applied in joining the elongated cap member to the anode rod member or if the wall thickness is insufficient to withstand such force, the cap member is confined or restrained in a suitable mechanism, such as a quick-opening, threaded die which will mate with the outer surfaces of the cap member and its threads in order to maintain the integrity of the external configuration of the elongated cap member and its external threads. The anode rod assembly formed by the method of the instant invention has a substantially improved service life and overcomes the difficulties and problems of prior art anode rods as represented by those in the prior art such as referred to previously.

The invention also advantageously provides, during the forming or heading operation, an enlarged or bulged roll-like portion of metal which seals the juncture between the end of the cap member and the anode rod member and additionally adds a substantial amount of anode metal at this juncture. This sealing and adding of metal substantially aids in prolonging the effective life of the anode rod assembly because attack or necking of the anode rod may take place at this juncture while the anode rod is cathodically protecting a metal tank.

Further, in producing the anode rod assembly according to the instant method, the anode rod is maintained straight and the cap member is in correct alignment with the rod; therefore, no subsequent straightening operation is required. Too, as there are fewer manipulative steps in making this anode rod assembly as compared to the forming of conventional anode rod assemblies, there is realized a substantial savings in labor.

BRIEF DESCRIPTION OF DRAWINGS

The invention will be further understood and the advantages thereof will become more apparent from the ensuing detailed description when taken in conjunction with the appended drawings wherein:

FIG. 1A is partly in section to show the salient features of the joint between the elongated cap member and the anode rod extremity which is effected by the joining or heading operation of the invention.

DETAILED DESCRIPTION OF THE INVENTION

Figure 1:
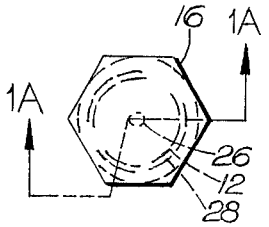
FIGS. 1 and 1A are a top plan view and a side elevation view, respectively, of the novel rod assembly which is formed by the joining or heading method of the instant invention, FIG. 1A being taken along the lines 1A—1A of FIG. 1.
Figure 1A:
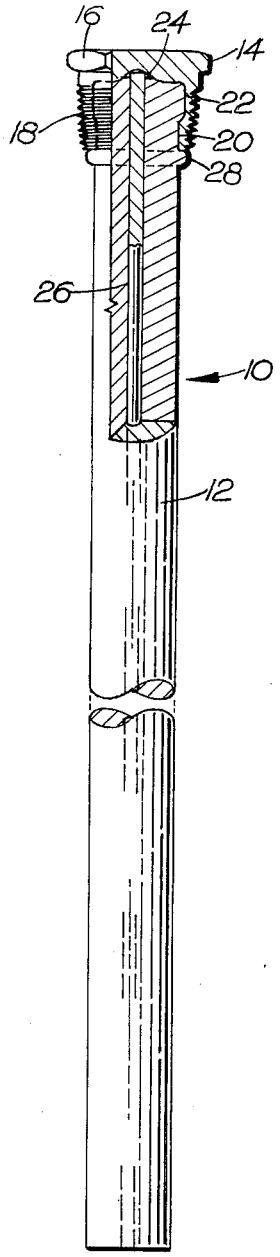

With reference to the drawings which are for the purpose of illustrating rather than limiting the invention, there is shown in FIGS. 1 and 1A novel anode rod assembly 10 which is formed by the novel joining or heading operation of the invention. Anode rod assembly 10 is generally comprised of an elongated cylindrical anode rod member 12 of a galvanically active metal, and a cap member 14 which usually is of ferrous metal; however, other metals, such as brass, may be used. Cap member 14 is provided with an axially positioned internal recess or bore 20 which has at least one enlarged portion or zone 22 which is remote from the opening of recess 20. The cap member 14 is provided with an enlarged head 16 suitably shaped to be turned by a wrench, preferably hexagonally shaped, to facilitate insertion and removal of the anode rod assembly 10 into a tank. The cap member is also provided, by machining, with a conically shaped cavity 24 centrally positioned in the base of the internal recess 20. For the generally used applications of the anode rod assembly 10, the cap member 14 is tapered and provided with machine threads 18 on its external surface for mating engagement with a suitable threaded coupling which is either integral with or fixedly attached to the tank to be protected. Cavity 24 serves a function during the joining or heading operation of the anode rod 10 and the cap member 24, and also assists in providing an auxiliary electrical connection between the anode rod 10 and cap member 24 as will be described hereinafter.

Anode rod member 12 is fabricated from a galvanically active metal, such as aluminum, magnesium, zinc, or their respective alloys, and includes an axially and centrally disposed core wire or rod 26, usually of ferrous material, generally running the entire length of the anode rod 12. The anode rod 12 may be fabricated by an extrusion method or a casting method; however, the most generally used procedure is to extrude the galvanically active metal onto the rod or wire.

The anode 12 has a cross-sectional configuration which will snugly fit in the internal recess or bore 20, i.e., the diameter of the anode rod is slightly less than the least diameter of the recess 20. To form the tight, leakproof joint of the invention between the anode rod 12 and the cap member 14, the anode rod 12 is inserted into the internal recess 20 and the anode rod 12 is subjected to a forging or metallurgically upsetting operation hereinbelow described. By using this type of forming or heading operation to effect the joint, the metal of the extremity of the anode rod member is caused to flow and uniformly fill the recess 20 and is therefore placed in a worked condition. As advantage of this forming or heading operation is that anode metal is added or increased at a zone of precise need. The prior art methods of forming anode rod assemblies not only neglected this need but also further detracted from this zone by removing metal by machining and/or threading.

In the instant invention, by continuing the forging operation after the upsetting of anode rod metal into enlarged zone 22, further displacement of metal will advantageously form an enlarged or bulged roll-like portion 28 of anode rod metal at the base of the cap member 14. This displacement of metal can be readily controlled so that the desired amount of additional metal is formed as will be further described hereinbelow. The enlarged portion 28 ensures the sealing off of the joint interface or juncture between the anode rod member 12 and the cap member 14. Further, the roll or bulge 28 provides a substantial amount of additional anode metal at the base of the cap member 14, thereby increasing the effective life of the anode rod assembly.

The mechanical strength and the electrical conductivity of the joint of the invention is a substantial improvement over other methods of construction of anode rod assemblies such as described previously and will be further described below in relation to FIGS. 3A, 3B and 3C. Further, the process of the instant invention in reducing the manipulative steps which are required in the making of the conventional anode rod assemblies substantially reduces the labor required. These commercially important advantages are realized along with an added advantage that the anode rod assemblies are substantially true or straight within very close tolerances and do not require any straightening operation subsequent to the joining or heading the cap member onto the anode rod extremity.

Figure 2:
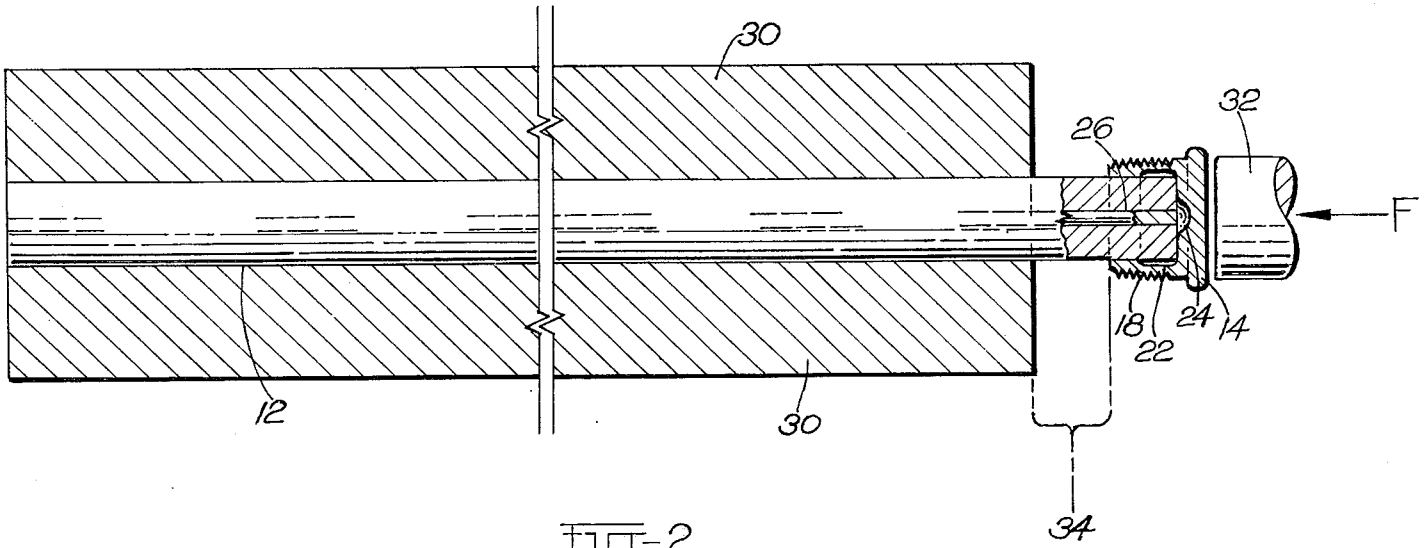
FIG. 2 is a side elevation view in section of suitable apparatus, in simplified form, for joining the anode rod member and the anode rod cap member to form the anode rod assembly according to the invention.
Figure 2A:
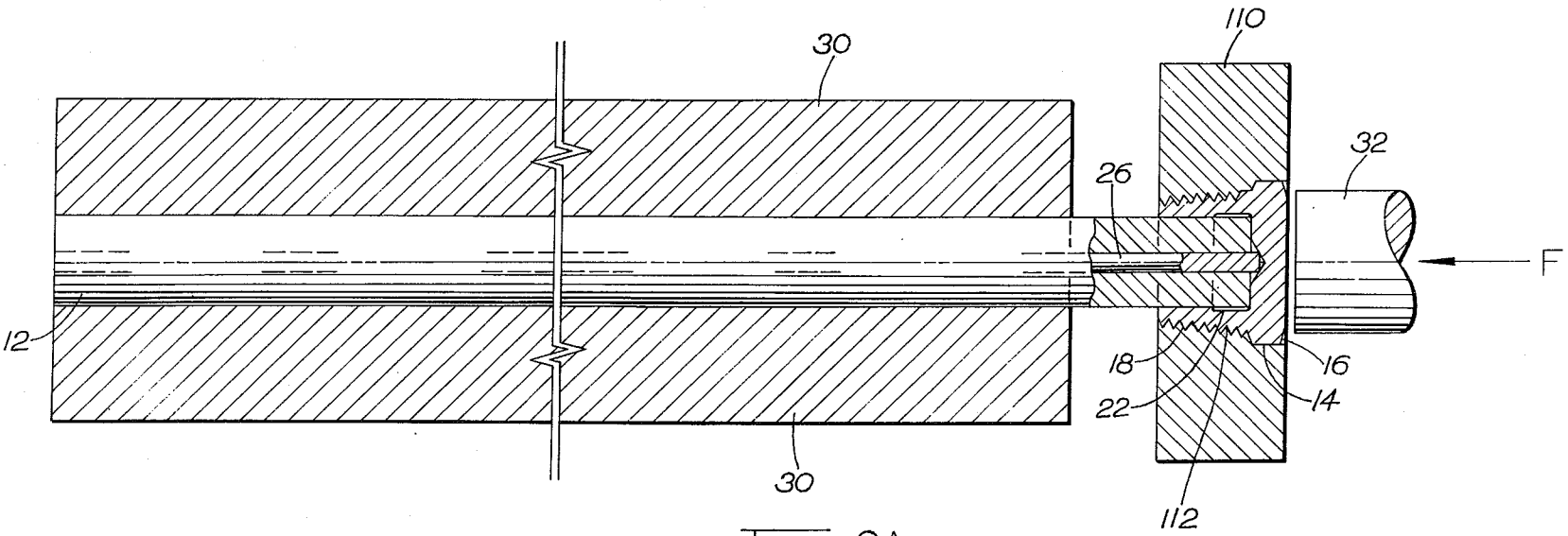
FIG. 2A is a side elevation view in section of an apparatus modified in part from that shown in FIG. 2, in simplified form, for joining the cap member to the anode rod extremity which may be utilized in practice of the invention.
Figure 2B:
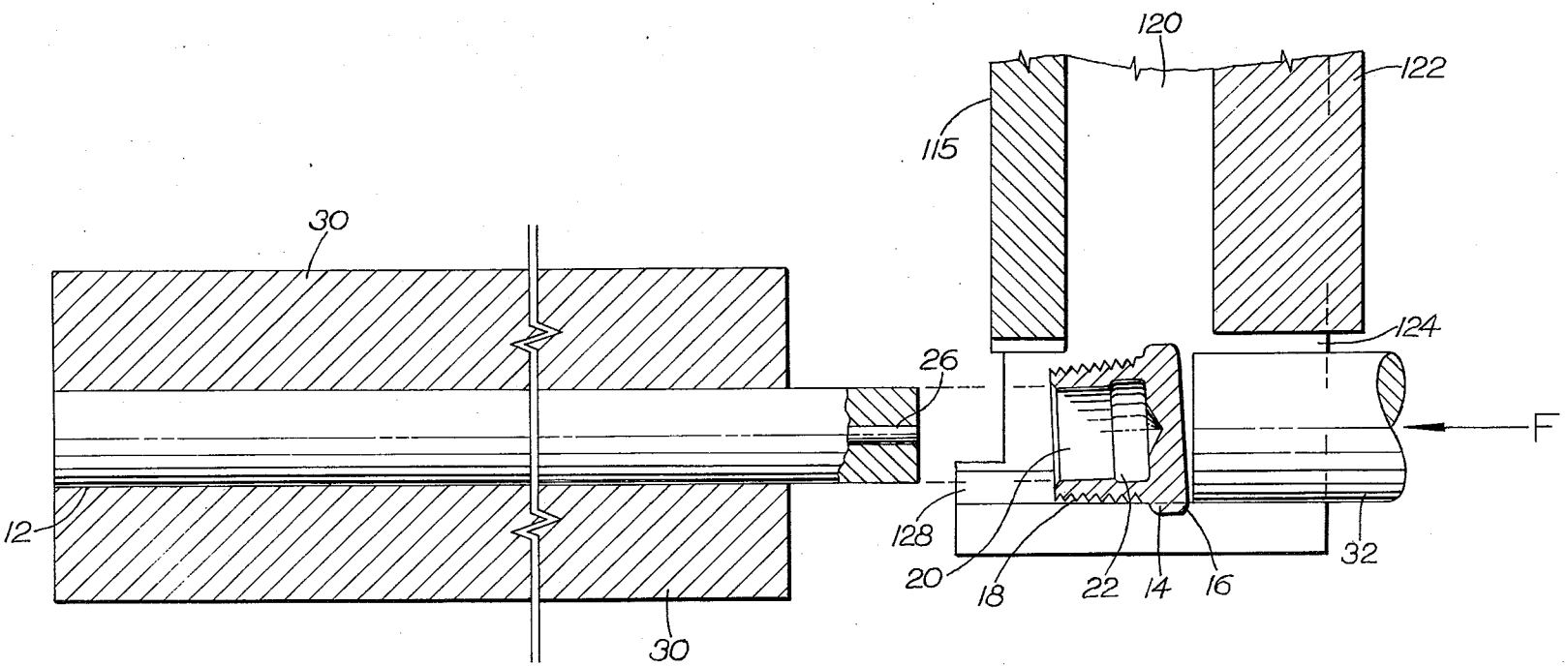
FIG. 2B is a side elevation view in section and partically broken of an apparatus modified from that shown in FIG. 2, in that a feeding mechanism, shown in simplified form, for feeding the elongated cap members in succession to the operation has been added.
Figure 2C:
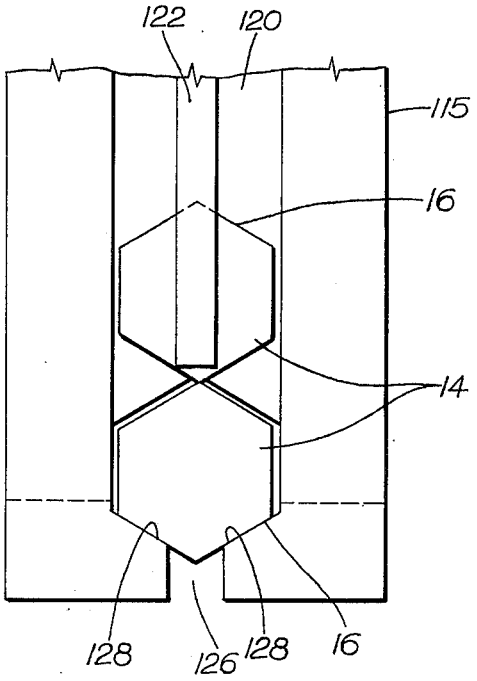
FIG. 2C is an end view partially in section and with parts removed for clarity, of the feeding mechanism of FIG. 2B showing the position of cap members for feeding to successive forming or heading operations.

The forming of the anode assembly 10 is depicted schematically in the apparatus shown in FIG. 2, and the modifications of the apparatus shown in FIGS. 2A, 2B and 2C. A major part of the body of the anode rod member 12 is tightly and fixedly supported in force-applying surfaces, such as clamping jaws 30, in order to prevent deformation and bending of this portion of the anode rod member 12. The unsupported length of the anode rod, which is only a small fraction of the total rod length, is designated at 34 in FIG. 2 and depends upon the deformation desired of the anode rod member 12 within the internal recess 20 and also upon the amount of additional metal in the enlarged portion 28 (shown in FIG. 1) that is desired. The cap member 14 is slipped over the extremity of the anode rod 12 either manually or by a suitable feeding mechanism shown in FIGS. 2B and 2C described hereinbelow, and a suitable force, designated as F, is applied to the cap member by a suitably powered ram member designated as 32. As the cap member 14 is displaced in the direction of force F, anode rod metal of the unsupported section is caused to flow so that it fills the enlarged area or zone 22 of the internal recess 20. The core wire 26 is not displaced during the forming operation, but the relative movement between it and the anode metal forces it into contact with the metal surfaces of the cavity 24 of cap member 14. Further application of force after the core wire is seated in cavity 24 causes further deformation of the anode metal in the unsupported length of the anode rod to form the enlarged roll-like portion 28.

For the joining operation, the surfaces of recess 20 are substantially uniformly lubricated with a suitable joint material or contact lubricant which is compounded to assist in penetrating the thin film of oxide on aluminum surfaces and to ensure a high electrical conductivity joint, and, furthermore, the contact lubricant aids in ensuring the permanence of the joint by sealing out air and moisture, preventing corrosion and the reformation of an oxide film. Alternatively, the surfaces of the anode rod extremity prior to positioning the cap member 14 thereon may be substantially uniformly lubricated with the joint material. It is important that there is a substantially uniform film of contact lubricant between the mating or engaging surfaces of the anode rod member and the internal recess of the cap member when the cap member is positioned onto the anode rod. Suitable joint materials or contact lubricants are well known in the electrical field as "connector aids" and are utilized extensively in electrical connections, particularly those involving aluminum conductor wires. They are made by suspending fine metal particles in a viscous carrier. An important function of the contact lubricant is to establish a profusion or a multitude of electrical bridges between the engaged metal surfaces of the anode rod member and the cap member. One suitble joint material is Penetrox A sold by Burndy Corporation of Norwalk, Conn., as listed in the Burndy Catalog No. P8A, 1967. Penetrox A joint compound consists of zinc granules suspended in a petroleum-based carrier. Another suitable example is petrolatum to which has been added zinc powder or dust, for example, about 25% by weight of zinc powder.

For facilitating commercial-scale production of anode rod assemblies, the depth of cavity 24 may be such that it will control the amount of anode metal displaced, i.e., when core wire 26 becomes positioned at the apex of the cavity 24, the exact amount of anode metal will be displaced to fill the enlarged zone 22, as well as the other zones of the internal recess 20 of the cap member 14. The remaining void in cavity 24 will then be filled with the joint material. The core wire 26 in abutting relationship with the metal surfaces of cavity 24 of cap member 14 forms an electrical connection between the anode rod 12 and cap member 14, however, the profusion or multitude of current-carrying bridges between the engaging surfaces of the cap member 14 and the anode rod 12 constitute such superior accessibility for current travel that the connection between core wire 26 and the cap member 14 is not a necessary requirement for current passage. As stated previously, the abutting of core wire 26 and the surfaces of cavity 24 is primarily for signalling that the anode metal has been displaced a sufficient amount to fill the internal recess or bore 20 so that the metal of the extremity of anode rod 12 is in a tightly locked, leakproof engagement with the surfaces of the internal recess 20 of cap member 14.

FIG. 2A is a schematic drawing of an apparatus similar to that shown in FIG. 2 for forming the anode rod assembly 10, except that it provides for a modification to prevent the force of forming or heading from affecting the integrity of the external surfaces of the cap member 14 or damaging of the external threads 18 during the forming or heading operation. The modification is comprised of a suitable mechanism for containing or confining the external surfaces of the cap member 14 during the heading or forming operations, such as a quick-operating die member 110. The die member 112 would have jaws which are threaded and tapered to mate with the configuration of the external surfaces and threads of the cap member 14. The die member 110 would be necessary when the minimum wall thickness of the cap member, designated by the number 112 in FIG. 2A, is below a critical thickness. The minimum thickness 112 depends upon the composition of the cap member 14, as well as the composition of the galvanically active metal of the anode rod 12 and can be determined by calculation or by empirical experimentation.

FIGS 2B and 2C relate to a further modification of a forming apparatus as shown in FIG. 2 wherein there is depicted, in schematic form, a feeding mechanism for feeding cap members 14 to the forming apparatus. The feeding mechanism depicted is a magazine 115 wherein cap members 14, having hexagonal heads, are loaded therein in succession for successive heading operations. A slot 120, in which the hexagonal heads 16 of the cap members 14 are guided, serves to maintain the cap members 14 in alignment for the successive forming operations. The magazine 120 can be either hand-loaded or it can be easily modified that it can be automatically loaded. The magazine 115 is provided with an opening 124 through which the ram 32 can be pushed into to pick up the lowest cap member 14 and upon the application of pressure, proceed through the opening 124 to push the cap member 14 onto the anode rod extremity and then to perform the forming or heading operation. Upon retraction of the ram 32, the next successive cap member 14 drops down into position for the subsequent heading or forming operation.

The magazing 115 shown in FIGS. 2B and 2C has a slot 120 and an adjustable back guide bar 115. Slot 120 has a width slightly greater than the diametrically opposite flats of the hexagonal head of a cap member 14. The length of slot 115 which is adjusted by back guide 115 is set so that it has a somewhat greater length than that of a cap member 14. Consequently, the cap members 14 can only enter the slot with the flats of the hexagon vertical and one point of the hexagon straight down and one straight up.

An opening cut 126 in the bottom of magazine 115 permits the cap member 14 to come to rest at a point in the center of two flat surfaces 128 that slope away from the bottom hexagon point as shown in FIG. 2C. The cap member, as shown in FIG. 2B, is tipped slightly downward at the outboard end.

The ram 32 which is circular in cross section has an end which is substantially a true vertical plane. When ram 32 pushes on the cap member 14, it causes the outboard end of cap member 14 to raise slightly and to be in line with the anode rod extremity. An entering chamfer may be provided on the end of the recess or bore 20 to assist in lining up the cap member 14 with the anode rod member extremity.

Figure 3A:
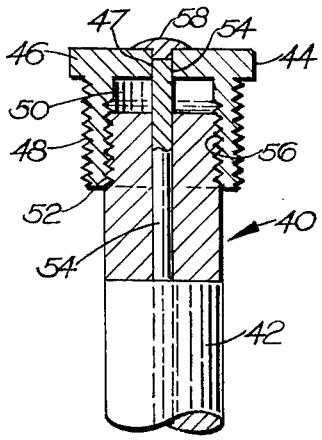
FIG. 3, comprised of FIGS. 3A, 3B and 3C, are side elevation views, partially in section, of prior art anode rod assemblies.
Figure 3B:
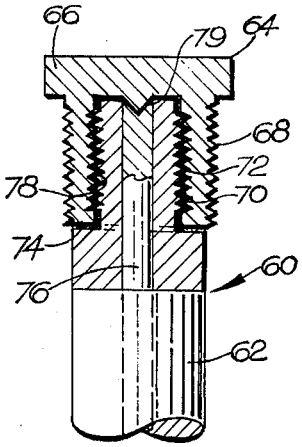
Figure 3C:
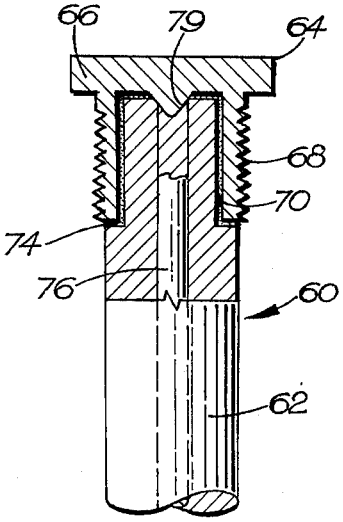

FIG. 3, which is comprised of FIGS. 3A, 3B and 3C, depict prior art anode rod assemblies which are commonly used in sacrificially protecting metal tanks such as water heaters. FIG. 3A shows an anode rod assembly 40 comprised generally of an anode rod 42 and a cap member 44. The cap member 44 has a machined internal recess 50 which is provided with internal threads 52 for engagement with the anode rod 42. External threads 48 on the cap member 44 are provided for engagement with a suitable threaded coupling member of a tank. The anode rod 42 which is of a suitable galvanically active metal, such as magnesium, is provided with a ferrous metal rod or wire 54 axially positioned therein. The cap member 44 is also provided with a suitable head member 46 which is of a suitable shape that can be engaged by a wrench, e.g., hexagonally shaped. The head 46 is also provided with a centrally located opening a hole 47. The anode rod 42 is provided with a threaded portion at the extremity denoted by 56. In engaging the anode rod 42 with the cap member 44, the mating threads 52 and 56 of the cap member 44 and anode rod member 42, respectively, are engaged. As shown in FIG. 3A, the anode core wire 54 extends beyond the anode rod 42 and projects through the opening or hole 47 of the head 46 of cap mmeber 44. The anode core wire 54 is then joined to cap member 44 by means of a weld 58 in order to accomplish a good electrical joint between the anode rod 42 and elongated cap member 44.

The anode rod assembly shown in FIGS. 3B and 3C are those which are depicted in FIGS. 2 and 3, respectively, of U.S. Pat. No. 3,558,463. As the anode rod assemblies of FIGS. 3B and 3C are very similar, like numbers will be used to designate like parts, the only difference being in the joining of the anode rod to the anode rod cap. In FIGS. 3B and 3C, the anode rod assembly is designated as 60 and is comprised of an anode rod 62 and cap member 64. The cap member 64 is provided with a machined recess 70 and in the case of FIG. 3B, the recess is provided with internal threads 72. Cap member 64 is also provided with a head portion 66 which is of a suitable shape, e.g., hexagonal, for the engagement of a wrench for installation into a suitable threaded coupling of a tank. The cap member 64 is also provided with external threads denoted by 68. Anode rod 62 is provided with a ferrous material core wire or rod 76 which is axially positioned in the anode rod 62. In the case of FIG. 3B, the extremity of the anode rod has machine threads 78 which mate with the internal machine threads 72 of the cap member 64. During engagement of the anode rod 62 wiht the cap member 64, in the case of the anode rod assembly in FIG. 3B, the anode rod 62 is screwed into the cap member 64. An adhesive material compound 74, such as an epoxy resin containing nickel powder, is employed between the mating threads 72 and 78 and also at the extremity of the anode rod cap 64 where it meets the anode rod 62 in order to ensure adhesion and electrical contact between anode rod 62 and the cap member 64.

In FIG. 3C, the internal recess 70 is not provided with machined threads, rather the anode rod extremity is only machined and inserted into the internal recess 70 with the adhesive material 74, such as the aforementioned epoxy resin with nickel powder, and the joint between anode rod 62 and cap member 64 depends for its strength and electrical contact solely on the adhesive 74. In both of the anode rod assemblies depicted in FIGS. 3B and 3C, the cap member 64 is provided with a conical projection 79 at the top or base of the internal recess or bore 70. During engagement between the anode rod 62 and cap member 64, the concial projection 79 becomes embedded in core wire or rod 76, thereby improving the electrical contact between the anode rod 62 and the cap member 64.

In the prior art anode rod assemblies depicted in FIG. 3 which are typical of the commerical anode rod assemblies used presently on tanks, such as water heaters, the extremity of the anode rod which engages the cap member must be machined, thereby removing metal precisely at the location where the anode rod assembly will be prone to excessive attack.

Figure 4:
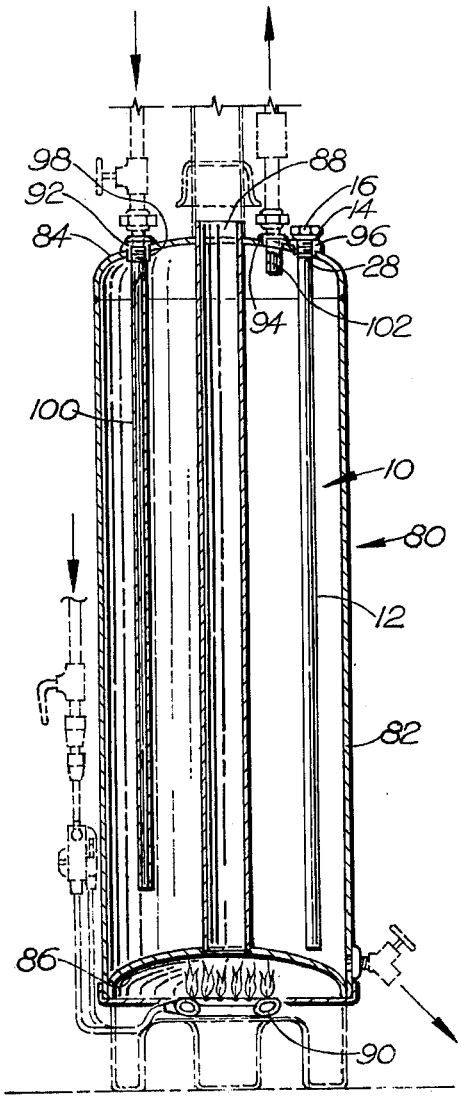
FIG. 4 is a side elevation view, in section of a conventional gas water heater employing the novel anode rod assembly of the invention and showing the general relationship of the anode rod assembly with respect to the tank and other components, e.g., cold water inlet and hot water inlet of a water heater.

FIG. 4 is illustrative of a typical usage of the anode rod assembly of the instant invention. In FIG. 4, there is shown a conventional gas-fired water heater 80 which is comprised of a cylindrical sidewall 82, top wall 84 and bottom wall 86 and a flue member 88, all of which are fabricated from a ferrous material, such as cold rolled sheet steel. The top wall 84 and the bottom wall 86 may be secured to the cylindrical wall 82 by any suitable manner, usually by welding. Flue member 88, which is disposed within cylindrical sidewall portion 82 and protrudes through top wall 84 and bottom wall 86, is secured to the top wall 82 and bottom wall 84 by a suitable means, such as by welding. A gas burner 90 is disposed adjacent the bottom of flue member 88 in a manner well known in the art and is connected to a suitable source of gas supply as shown in phantom lines in FIG. 4. Inlet and outlet water connections, such as the cold water inlet pipe 98 and the hot water outlet pipe 102, are also provided, being joined to the top wall or cover 84 by suitable means, such as the pretapped threaded couplings 92 and 94, respectively. In FIG. 4, the threaded couplings 92 and 94 are shown as joined by welding to the top wall or cover 84. The cold water inlet pipe 98 has an extension known as a dip tube 100 which has an outlet in the lower portion of the tank.

The anode assembly 10 which is comprised of cylindrical anode rod 12 and cap member 14 is generally disposed in the tank 80 through top wall or cover 84 by any suitable means, such as by threading the external threads 18 of cap member 14 into the pretapped, threaded coupling 96 welded to top wall 84. An alternate method of joining the cap member to a tank wall would be by a welded joint. It is customary that the anode rod extend to the bottom of the tank, generally to within 2 or 3 inches from the bottom wall 86.

Almost all commercial water heater tanks are glass lined steel. Glass lined steel water heater tanks have been found to render a satisfactory life and yet be ecomonical in cost. In addition, glass lining has advantages over some of the previously used tanks, e.g., they are cleaner than galvanized steel tanks. In the normal fabrication of a water heater, such as the gas heated water tank 80 of FIG. 4, there is installed a single cathodic protection anode; however, two or more anodes can be used for cathodic protection in areas where the water presents a difficult corrosion problem. Also, in tanks which are particularly large, it may be advantageous to employ multiple anodes for cathodic protection.

As stated before, FIG. 4 is merely for illustrative purposes for showing a typical application of the anode rod assembly of the invention. It is generally applicable and effective in protecting the internal metal surfaces of electrically heated water heaters against corrosion, as well as internal surfaces of other metal vessels.

The diameter of the anode rod is optional, as well as the size of the anode wire or rod. An anode rod, e.g., of extruded aluminum or magnesium, may vary in diameter from ½ inch to 2 inches, a typical anode rod is one having a ¾ inch diameter. The core wire, usually steel wire, may have a diameter ranging from about 1/16 inch to ¼ inch. A typical example for the core wire would be United States Steel Wire Gage No. 10 (0.135 inch diameter) steel, bright, basic black annealed wire.

As illustrative of forming the anode rod assembly of the invention, extruded elongated anode rods of aluminum alloy having central core wires of 10 gage steel wire and having a diameter of 0.625 inch were headed with standard ¾ pipe caps of ⅞ length and of AISI-C12L15 steel. This steel is a free machining steel having 0.12% by weight carbon and 0.15% by weight of lead in its composition. The diameter of the recess (smallest diameter) was 0.635 inch ± 0.005 inch, while the diameter of the bulged portion of the recess (22 in FIG. 1A) was 0.690 inch ± 0.005 inch. The minimum wall thickness of the cap members (measured from the internal surface of the recess to the base or root of the threads) was approximately 0.142 inch. The external surface of the cap members was tapered (¾ per foot) and the external machine threads had an average diameter of 1 inch measured from peak to peak of the threads. The threads were 14 NPT (National Pipe Threads) or 14 threads to the lineal inch.

In forming the anode rod assembly, the anode rod member was placed between clamping jaws, such as shown in FIG. 2, and held tightly between the jaws by a clamping force or 90,000 pounds. The small amount of extremity protruding from the clamping jaws should be sufficient to accommodate the recess of the cap member plus the amount of metal needed for deformation within the recess and in forming the enlarged portion (shown as 28 in FIG. 1A). In the instant example, this length in the case of the 0.625 inch anode rod was 15/16 of an inch. Contact lubricant was substantially uniformly placed around the surfaces of the protruding extremity of the anode rod, and the cap member was then placed on the protruding anode rod extremity. A ram, such as shown in FIG. 2, then applied sufficient force to the cap member to effect the forming operation. In the instant example, a force of 7,500 pounds was used to deform the metal in the recess in the cap and to form the enlarged or bulged portion aforementioned.

It has been found that if the minimum wall thickness, as defined previously, of the elongated cap member is below about 0.081 inch, it is necessary to use a suitable confining or containing mechanism such as the quick-connecting/disconnecting die described in relation to FIG. 2A in order to preserve the integrity of the outer surface of the cap member and to prevent damage to its threads.

The anode rod assembly of the invention is particularly adapted for anode rods of aluminum and aluminum alloys because of their excellent formability. This is due to the fact that aluminum crystallizes in the face centered cubic system. Metals which crystallize in the cubic system are generally noted for their excellent properties for working of the metal, such as rolling, forging, extruding and other forming operations. The atoms are oriented in such a manner that during a forming or working operation, the metal flows in an orderly fashion. Magnesium, zinc and their alloys which crystallize in the hexagonal system do not possess the excellent formability characteristics of aluminum and its alloys. However, anode rods of these latternamed metals can also be employed in making the advantageous anode rod assemblies of the invention.

By the practice of the instant method of producing anode rod assemblies, there are a number of advantages, besides producing superior mechanical and electrical joints between the anode rods and the cap members. The anode rod assemblies are straight and do not require any subsequent straightening operation. This is primarily due to the fixedly clamping of the major portion of the anode rod during the clamping operation. Too, the cap member is formed onto the anode rod in precise alignment. Also, because of the elimination of a number of other manipulative steps required in the making of the conventional anode rods, such as threading or removing metal from the extremity of the anode rod or welding of the core wire to the cap mamber as shown in FIG. 3A, there is a substantial savings in labor. Further, it has been found that in producing the anode rod assemblies, there has been great reliability, i.e., the rejects have been exceedingly low. For example, in the production of 2,500 anode rod assemblies according to the instant method, there were no rejects.

Advantageous embodiments of the invention have been shown and described, and it is obvious that various changes and modifications can be made therein without departing from the appended claims, wherein:

I claim:

1. The method of making a sacrificial anode assembly for the cathodic protection of the internal surfaces of ferrous metal water-containing vessels comprising:

A. providing an anode rod member of a galvanically active metal and of a selected length and a selected substantially uniform diameter throughout its length and wherein the galvanically active metal surrounds a centrally disposed core wire;

B. providing an externally threaded elongated hollow metal cap member of a dissimilar from the galvanically active metal anode member and of a selected wall thickness, said cap member being provided with an internal recess which extends axially inwardly from an opening at one end of the cap member for a selected distance therein, said recess having a diameter slightly greater than the diameter of the anode rod member and at least one portion of said recess remote from said end of said cap member having a relatively greater diameter with respect to the remainder of said recess, said recess having at its base a centrally located cavity;

C. clamping and tightly holding the major portion of said anode rod member between a plurality of force-applying surfaces substantially conforming in shape to the external configuration of the anode rod member while allowing a minor portion of one extremity of the anode rod member to protrude a selected small amount from said force-applying surfaces;

D. applying a selected amount of an electrical contact lubricant containing metal particles to at least one of said members in the area where the members are to be joined;

E. positioning and aligning said cap member onto the anode rod member extremity which protrudes from said force-applying surfaces such that the anode rod member extremity fits snugly into said recess of said cap member and the cap member is axially aligned with the anode rod member extremity while ensuring that the engaging surfaces of said cap member and said anode rod member extremity have positioned therebetween a substantially uniform distribution of the electrical contact lubricant; and F. applying to the cap member a sufficient force in the longitudinal direction of the anode rod member and the elongated cap member positioned thereon to metallurgically upset the galvanically active metal of the said extremity of the anode rod member to cause the galvanically active metal to flow and substantially uniformly fill the recess of the cap member, including the portion of the recess having a relatively greater diameter and effect contact between the core wire and the walls of the centrally located cavity of the recess, thereby producing a sacrificial anode assembly while establishing a tight, leakproof joint with a multiple of current-carrying bridges of metal particles between the engaging wall surfaces of said anode rod member extremity and the walls of said recess and without materially disturbing the initial wall thickness and basic configuration including the external threads of the elongated cap member.

2. A method of making an anode rod assembly according to claim 1 including the step of continuing the application of the force beyond that necessary to cause the anode metal to flow and substantially uniformly fill the recess in order to form an enlarged roll-like portion of anode metal extending peripherally around said anode rod, thereby sealing the juncture between the anode rod member and the end of the cap member and adding additional anode metal thereto.

3. The method of making a sacrificial anode assembly for the cathodic protection of the internal surfaces of ferrous metal water-containing vessels comprising:

A. providing an anode rod member of an aluminum alloy and of a selected length and a selected substantially uniform diameter throughout its length and wherein the aluminum alloy metal surrounds a centrally disposed steel core wire;

B. providing an externally threaded elongated hollow steel cap member of a selected wall thickness, said cap member being provided with an internal recess which extends axially inwardly from an opening at one end of the cap member for a selected distance therein, said recess having a diameter slightly greater than the diameter of the anode rod member and at least one portion of said recess remote from said end of said cap member having a relatively greater diameter with respect to the remainder of said recess, said recess having at its base a centrally located cavity;

C. clamping and tightly holding the major portion of said anode rod member between a plurality of force-applying surfaces substantially conforming in shape to the external configuration of the anoe rod member while allowing a minor portion of one extremity of the anode rod member to protrude a selected small amount from said force-applying surfaces;

D. applying a selected amount of an electrical contact lubricant containing metal particles to at least one of said members in the area where the members are to be joined;

E. positioning and aligning said cap member onto the anode rod member extremity which protrudes from said force-applying surfaces such that the anode rod member extremity fits snugly into said recess of said cap member and the cap member is axially aligned with the anode rod member extremity while ensuring that the engaging surfaces of said cap member amd said anode rod member extremity have positioned therebetween a substantially uniform distribution of the electrical contact lubricant; and F. applying to the cap member a sufficient force in the longitudinal direction of the anode rod member and the elongated cap member positioned thereon to metallurgically upset the aluminum alloy anode metal of the said extremity of the anode rod member to cause the anode metal to flow and substantially uniformly fill the recess of the cap member, including the protion of the recess having a relatively greater diameter and effect contact between the core wire and the walls of the centrally located cavity of the recess, thereby producing a sacrificial anode assembly while establishing a tight, leakproof joint with a multiple of current-carrying bridges of metal particles between the engaging wall surfaces of said anode rod member extremity and the walls of said recess and without materially disturbing the initial wall thickness and basic configuration including the external threads of the elongated cap member.

4. A method of making an anode rod assembly according to claim 3 including the step of continuing the application of the force beyond that necessary to cause the aluminum alloy anode metal to flow and substantially uniformly fill the recess in order to form an enlarged roll-like portion of anode metal extending peripherally around said anode rod, thereby sealing the juncture between the anode rod member and the end of the cap member and adding additional anode metal thereto.

5. The method of making a sacrificial anode assembly for the cathodic protection of the internal surfaces of ferrous metal water heater tanks comprising:

A. providing a anode rod member of an aluminum alloy and of a selected length and a selected substantially uniform diameter throughout its length and wherein the aluminum alloy metal surrounds a centrally disposed steel core wire;

B. providing an externally threaded elongated hollow steel cap member of selected wall thickness, said cap member being provided with an internal recess which extends axially inwardly from an opening at one end of the cap member for a selected distance therein, said recess having a diameter slightly greater than the diameter of the anode rod member and at least one portion of said recess remote from said end of said cap member having a relatively greater diameter with respect to the remainder of said recess, said recess having at its base a centrally located cavity;

C. clamping and tightly holding the major portion of said anode rod member between a plurality of force-applying surfaces substantially conforming in shape to the external configuration of the anode rod member while allowing a minor portion of one extremity of the anode rod member to protrude a selected small amount from said force-applying surfaces;

D. applying a selected amount of an electrical contact lubricant containing metal particles to at least one of said members in the area where the members are to be joined;

E. positioning and aligning said cap member onto the anode rod member extremity which protrudes from said force-applying surfaces such that the anode rod member extremity fits snugly into said recess of said cap member and the cap member is axially aligned with the anode rod member extremity while ensuring that the engaging surfaces of said cap member and said anode rod member extremity have positioned therebetween a substantially uniform distribution of the electrical contact lubricant; and F. applying to the cap member a sufficient force in the longitudinal direction of the anode rod and the elongated cap member positioned thereon to metallurgically upset the aluminum alloy anode metal of the said extremity of the anode rod member to cause the anode metal to flow and substantially fill the recess of the cap member including the portion of the recess having a relatively greater diameter and effect contact between the core wire and the walls of the centrally located cavity of the recess thereby producing a sacrificial anode assembly wherein the anode rod member and the elongated cap member are in a tightly locked, leakproof joint and with a multitude of current-carrying bridges of metal particles between the engaging surfaces of said extremity of said anode rod member and said recess, said force being continued beyond that necessary to cause the anode metal to flow and substantially fill the recess in order to form an enlarged portion of anode metal extending peripherally around said anode rod to ensure sealing of the juncture between the anode rod member and the end of the cap member and to add additonal anode metal thereto, the selected minimum wall thickness of the elongated cap member as measured between the surface of the internal recess and the base of the threads, being sufficient to withstand the force of joining the said cap member to the said anode rod member in order to maintain the integrity of its external configuration and its external threads.

6. The method of making a sacrificial anode assembly for the cathodic protection of the internal surfaces of ferrous metal water heater tanks comprising:

A. providing an anode rod member of an aluminum alloy and of a selected length and a selected substantially uniform diameter throughout its length and wherein the aluminum alloy metal surrounds a centrally disposed steel core wire;

B. providing an externally threaded and tapered elongated steel cap member of a selected wall thickness, said cap member being provided with an internal recess which extends axially inwardly from an opening at one end of the cap member for a selected distance, therein, said recess having a diameter slightly greater than the diameter of the anode rod member and at least one portion of said recess remote from said end of said cap member having a relatively greater diameter with respect to the remainder of said recess, said recess having at its base a centrally located cavity;

C. clamping and tightly holding the major portion of said anode rod member between a plurality of force-applying surfaces substantially conforming in shape to the external configuration of the anode rod member while allowing a minor portion of one extremity of the anode rod member to protrude a selected small amount from said force-applying surfaces;

D. applying a selected amount of an electrical contact lubricant containing metal particles to at least one of said members in the area where the members are to be joined;

E. positioning and aligning said cap member onto the anode rod member extremity which protrudes from said force-applying surfaces such that the anode rod member extremity fits snugly into said recess of said cap member and the cap member is axially aligned with the anode rod member extremity while ensuring that the engaging surfaces of said cap member and said anode rod member extremity have positioned therebetween a substantially uniform distribution of the electrical contact lubricant;

F. clamping and tightly holding said elongated cap member in a quick-operating die member having force-applying surfaces which are tapered and threaded to mate with the external longitudinal surfaces and threads of the cap member in order that the integrity of the external configuration and the external threads of the cap member are maintained during the application of force in a forming operation; and G. applying to the cap member a sufficient force in the lingitudinal direction of the anode rod and the elongated cap member positioned thereon to metallurgically upset the aluminum alloy anode metal of the said extremity of the anode rod member to cause the anode metal to flow and substantially fill the recess of the cap member including the portion of the recess having a relatively greater diameter and effect contact between the core wire and the walls of the centrally located cavity of the recess, thereby producing a sacrificial anode assembly wherein the anode rod and the elongated cap member are in a tightly locked, leakproof joint and with a multitude of current-carrying bridges of metal particles between the engaging surfaces of said extremity of said anode rod and said recess and without materially disturbing the initial wall thickness and basic configuration including the external threads of the elongated cap member, said force being continued beyond that necessary to cause the anode metal to flow and substantially fill the recess in order to form an enlarged portion of anode metal extending peripherally around said anode rod, thereby sealing the juncture between the anode rod member and the end of the cap member and adding additional anode metal thereto.

* * * * *

UNITED STATES PATENT OFFICE

CERTIFICATE OF CORRECTION

PATENT NO. : 4,035,903

DATED : July 19, 1977

INVENTOR(S) : Lewis W. Taggart

It is certified that error appears in the above-identified patent and that said Letters Patent are hereby corrected as shown below:

Column 1, line 52, "well." should be --wall.--

Column 1, line 68, "by" should be --of--

Column 5, line 1, "anode" should be --anode rod--

Column 5, line 13, "As" should be --An--

Column 8, line 14, "a" first occurrence, should be --or--

Column 8, line 21, "mmeber" should be --member--

Column 8, line 47, "wiht" should be --with--

Column 9, line 61, "generally" should be --equally--

Column 10, line 10, "3/4 pipe caps of 7/8" should be --3/4" pipe caps of 7/8"--

Column 10, line 20, "(3/4 per foot)" should be --(3/4" per foot)--

Column 10, line 28, "or" should be --of--

Column 11, line 33 "dissimilar" should be --dissimilar metal--

Column 12, line 50, "anoe" should be --anode--

Column 12, line 66, "amd" should be --and--

Column 13, line 8, "protion" should be --portion--

UNITED STATES PATENT OFFICE

CERTIFICATE OF CORRECTION

PATENT NO. : 4,035,903

DATED : July 19, 1977

INVENTOR(S) : Lewis W. Taggart

It is certified that error appears in the above-identified patent and that said Letters Patent are hereby corrected as shown below:

Column 13, line 33, "a" should be --an--

Column 14, line 26, "additonal" should be --additional--

Column 15, line 18, "lingitudinal" should be --longitudinal--

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*